US007909332B2

(12) United States Patent
Root

(10) Patent No.: US 7,909,332 B2
(45) Date of Patent: Mar. 22, 2011

(54) INTERACTIVE SPORTS-THEMED GAME

(75) Inventor: John Root, Upper Darby, PA (US)

(73) Assignee: Bleacher League Entertainment, Inc., Upper Darby, PA (US)

( * ) Notice: Subject to any disclaimer, the term of this patent is extended or adjusted under 35 U.S.C. 154(b) by 269 days.

(21) Appl. No.: 12/150,723

(22) Filed: Apr. 30, 2008

(65) Prior Publication Data

US 2008/0274815 A1 Nov. 6, 2008

Related U.S. Application Data

(60) Provisional application No. 60/927,206, filed on May 2, 2007.

(51) Int. Cl.
*A63B 71/02* (2006.01)

(52) U.S. Cl. ..... 273/461; 273/459

(58) Field of Classification Search ..... 273/440, 273/459, 461

See application file for complete search history.

(56) References Cited

U.S. PATENT DOCUMENTS

| | | | | |
|---|---|---|---|---|
| 4,141,548 | A * | 2/1979 | Everton | 463/4 |
| 4,592,546 | A * | 6/1986 | Fascenda et al. | 463/29 |
| 5,730,443 | A * | 3/1998 | Allen | 273/459 |
| 5,769,714 | A * | 6/1998 | Wiener et al. | 463/3 |
| 5,782,470 | A * | 7/1998 | Langan | 273/139 |
| 5,884,914 | A * | 3/1999 | Lilien | 273/244.1 |
| 6,293,868 | B1 * | 9/2001 | Bernard | 463/42 |
| 6,338,486 | B1 * | 1/2002 | Hutchens | 273/298 |
| 6,663,107 | B2 * | 12/2003 | Fisher et al. | 273/292 |
| 6,783,128 | B2 * | 8/2004 | Casey et al. | 273/298 |
| 7,334,796 | B2 * | 2/2008 | Wittwer | 273/277 |
| 7,451,986 | B1 * | 11/2008 | Thrasher | 273/259 |
| 2006/0192334 | A1 * | 8/2006 | Wittwer | 273/277 |

* cited by examiner

*Primary Examiner* — Raleigh W. Chiu
(74) *Attorney, Agent, or Firm* — Eugene E. Renz, Jr.

(57) ABSTRACT

An interactive sports-themed game is disclosed. The game involves generating a list of predicted outcomes of the next play of a live sporting event, ranking the list, selecting one or more of the predicted outcomes to form a subset list. The outcome of the next play of the live sporting event is then compared to the subset list, and the player of the interactive sports-themed game is awarded points if the outcome of the play of the live sporting event matches one of the predictions in the subset list.

8 Claims, 6 Drawing Sheets

INTERACTIVE SPORTS-THEMED GAME

CROSS REFERENCE TO RELATED APPLICATIONS

This application claims benefit to U.S. provisional patent application 60/927,206, filed May 2, 2007.

FIELD OF THE INVENTION

The present invention relates generally to games. More particularly, the present invention pertains to game involving predicting the outcome of a live sporting event.

BACKGROUND

Activities based on predicting the outcome of sporting events are popular in today's culture. The motivation for these activities may include gambling, but may also include general amusement and entertainment purposes. Sporting events generate revenue by various means, such as ticket sales, concession sales (e.g. food and beverages), and advertising, among others. An activity that promotes the attendance and/or receiving broadcasts of live sporting events can add value to advertising, especially towards the latter parts of a sporting event. In many cases, if a sporting event turns out to be a one-sided "blowout," attendance and the number of viewers may plummet, thereby decreasing the effect of advertising. Therefore, it is desirable to provide an activity that promotes an audience engagement in a sporting event, regardless of the outcome of the event itself.

SUMMARY OF THE INVENTION

The main concept of the game of the present invention is to increase the fan's involvement in a live sporting event. The game of the present invention provides each player the opportunity of becoming interactive with each play of the real game. Beyond simply entertainment, the game of the present invention serves to keep fans in the seats or watching the game on television, since they are involved in every play of the real game. Unlike typical "fantasy" games that depend on the players of the fantasy game to select real players that perform well, the outcome of the game of the present invention is directly related to knowledge of the game, and is not dependent on good performance from a particular subset of athletes.

In one aspect of the present invention, the present invention provides for a game. The game comprises the steps of:

generating a list of predicted outcomes of the next play of a live sporting event;

selecting one or more of the predicted outcomes to form a subset list;

comparing the result of a real game to the predictions within the subset list; and awarding a point to a player if there is a match between the result of the real game, and one of the predictions within the subset list.

In another aspect of the present invention, the present invention provides for ranking the list of predicted outcomes by assigning a value to each predicted outcome, based on the likelihood of occurrence, wherein the likelihood of occurrence is inversely related to the assigned value.

DETAILED DESCRIPTION

In the ensuing description, the terms "real game" or "live game" refer to the live sporting event of which the events are being predicted. The term "virtual game" pertains to the interactive sports-themed game of the present invention. It is to be understood that, unless specifically stated to be otherwise, the term "player" in the context of the virtual game, may refer to a single person, or group of people. The term "result" as it pertains to a "real game" refers to a play of the live sporting event (e.g. a "triple" in baseball, or an "interception" in football).

Figure 1:
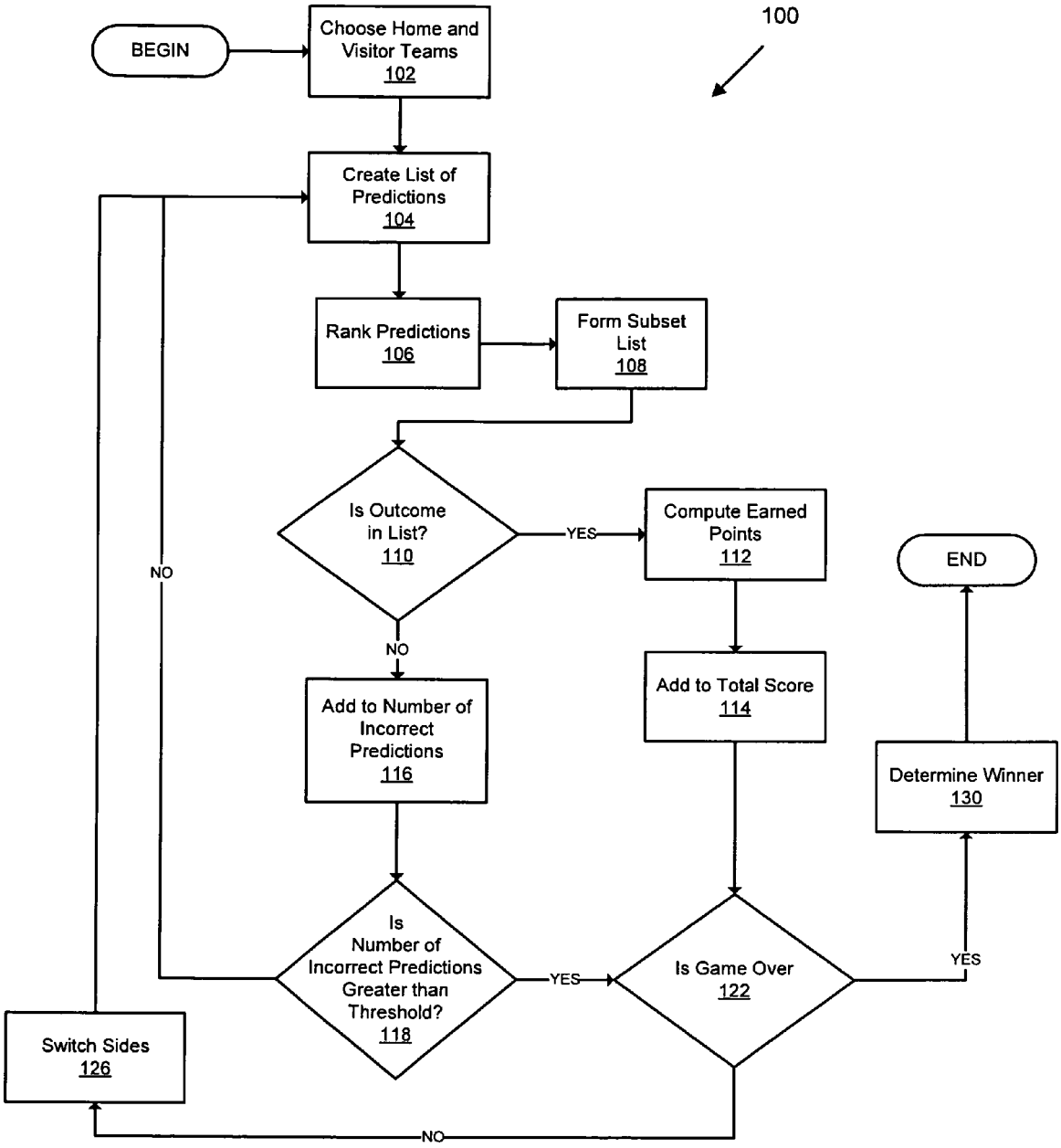
FIG. 1 is a flowchart showing the process steps for playing the game of the present invention.

FIG. 1 is a flowchart 100 showing the process steps for playing the game of the present invention. In this embodiment, the game of the present invention is played between two people, or two groups of people, to mirror the activity of the real sporting event. The game of the present invention is well suited to sports that have defined plays, such as baseball and football.

In step 102, the players decide who designated as "home" and "visiting" teams. This determines which player (or group) goes first. In one embodiment, the team designated as "visiting" goes first.

In step 104, a list of predictions is created. This list comprises a subset of possible outcomes that may occur. The level of detail of the predictions is chosen based on the desired virtual game difficulty level (e.g. "easy" or "difficult"). For example, in a baseball embodiment, a list of easy predictions may include: Out, Walk, Base Hit, and Home Run. To increase the level of difficulty, more detailed predictions are used. In an exemplary baseball embodiment, a difficult prediction list may include outcomes such as: Strike Out, Foul Out, Ground Out, Single, Double, etc. . . . .

In step 106, each prediction is ranked, based on likelihood of occurrence. For example, an Out may be given a rank of 1, as the most likely prediction, a base hit may be given a rank of 4, a walk may be given a rank of 6, and a home run may be given a rank of 10. In one embodiment of the game of the present invention, the outcomes are ranked a priori. In another embodiment of the game of the present invention, the ranking of step 106 is performed via a computer. The computer uses data pertaining to the current player(s) to assess appropriate rankings. For example, in the case of baseball, when a known "slugger" is at bat, the Home Run Ranking may be 6. When a pitcher (who rarely hits a home run) is at bat, the Home Run Ranking may be increased to 12. In this way, the ranking dynamically changes based on the specific players in the real game. In a baseball embodiment, various factors, such as batter batting average, pitcher strikeout percentage, the particular statistics of this batter against this pitcher, among others, can be used to choose a ranking based on the current activity of the real game.

In step 108, the player(s) select a subset of predictions from the list created in step 104 to form a subset list. The goal of the virtual game is to have the outcome of the next play of the real game match one of the predictions in the subset list.

In step 110, after the particular play of the real game has transpired, the outcome of the real game is compared to the predictions in the subset list (that was generated in step 108). If the outcome is present in the list, then the process proceeds to step 112, where the number of points earned is computed. In one embodiment, the number of points earned is simply the ranking. For example, if in the real game, the batter got a single, and in the ranking step 106, a single was given a rank of 3, then the players earn 3 points for their correct prediction. In step 114, the points earned in step 112 are added to the total score, to create a running total. The process then proceeds to step 122, which is explained in an upcoming paragraph.

If the outcome of the real game does not match any of the predictions in the subset list, then the process proceeds to step 116. In this step, the number of incorrect predictions is incremented by one. In the next step, the process proceeds to step 118, where the number of incorrect predictions is compared to a predetermined threshold value. The predetermined threshold value is selectable, but preferably matched to the theme of the real game. For example, in a baseball embodiment, the predetermined threshold is preferably 3 to correspond to the 3 outs of baseball. In a football embodiment, it is 4, to correspond to four downs of football. If the number of incorrect predictions exceeds the predetermined value, the current player's turn is over, and the process then proceeds to step 122.

In step 122, an evaluation is made to determine if the virtual game is over. The virtual game is over after a predetermined number of turns of each player. In one baseball embodiment of the game of the present invention, each player (or group) gets 5 turns. The virtual game is also over if the real game ends. If the virtual game is over, the process proceeds to step 130, where a winner is determined based on which player (or group) has the higher score. If the virtual game is not over, then the process proceeds to step 126, where the players switch sides, that is, the current player (or group) cedes their turn to the opposing player (or group), and the virtual game process repeats.

Figure 2:
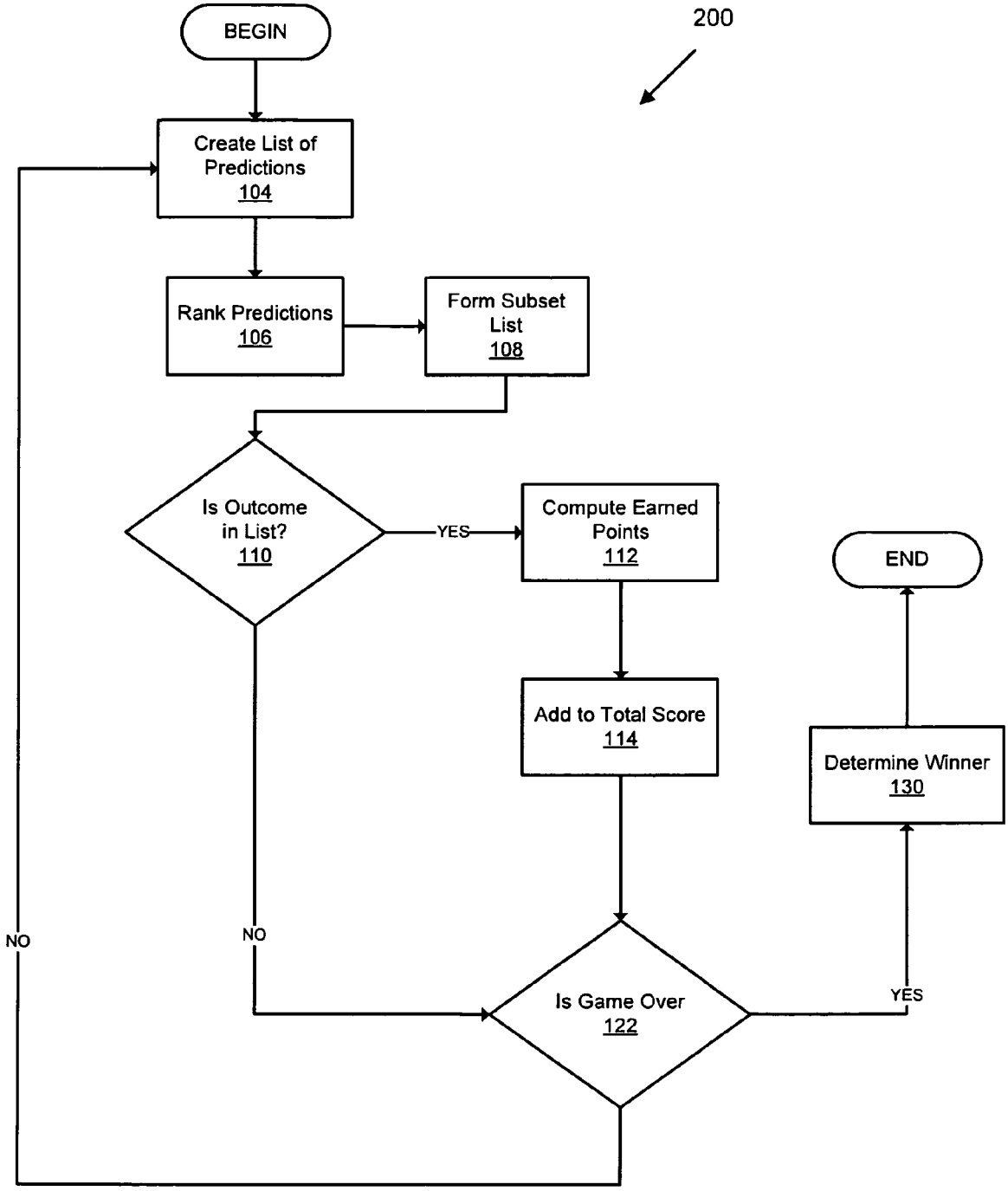
FIG. 2 is a flowchart showing process steps for an alternative method for playing the game of the present invention.

FIG. 2 is a flowchart 200 showing process steps for an alternative method for playing the game of the present invention. In this embodiment, some process steps have been removed from the process described by FIG. 1. In particular, steps 102 and 126 are removed. The notion of "switching sides" is not present in this embodiment. In the embodiment of FIG. 2, each player or group plays as long as the real game continues, or some other predetermined stopping point (e.g. time of day, number of plays predicted, etc. . . . ). In this case, each player (or group) plays against each other. At the end of the virtual game, the player with the highest score is the winner. The steps present in FIG. 2 are similar to like numbered steps of FIG. 1, and the aforementioned explanation of each of those steps also applies to the process illustrated in FIG. 2.

Figure 3:
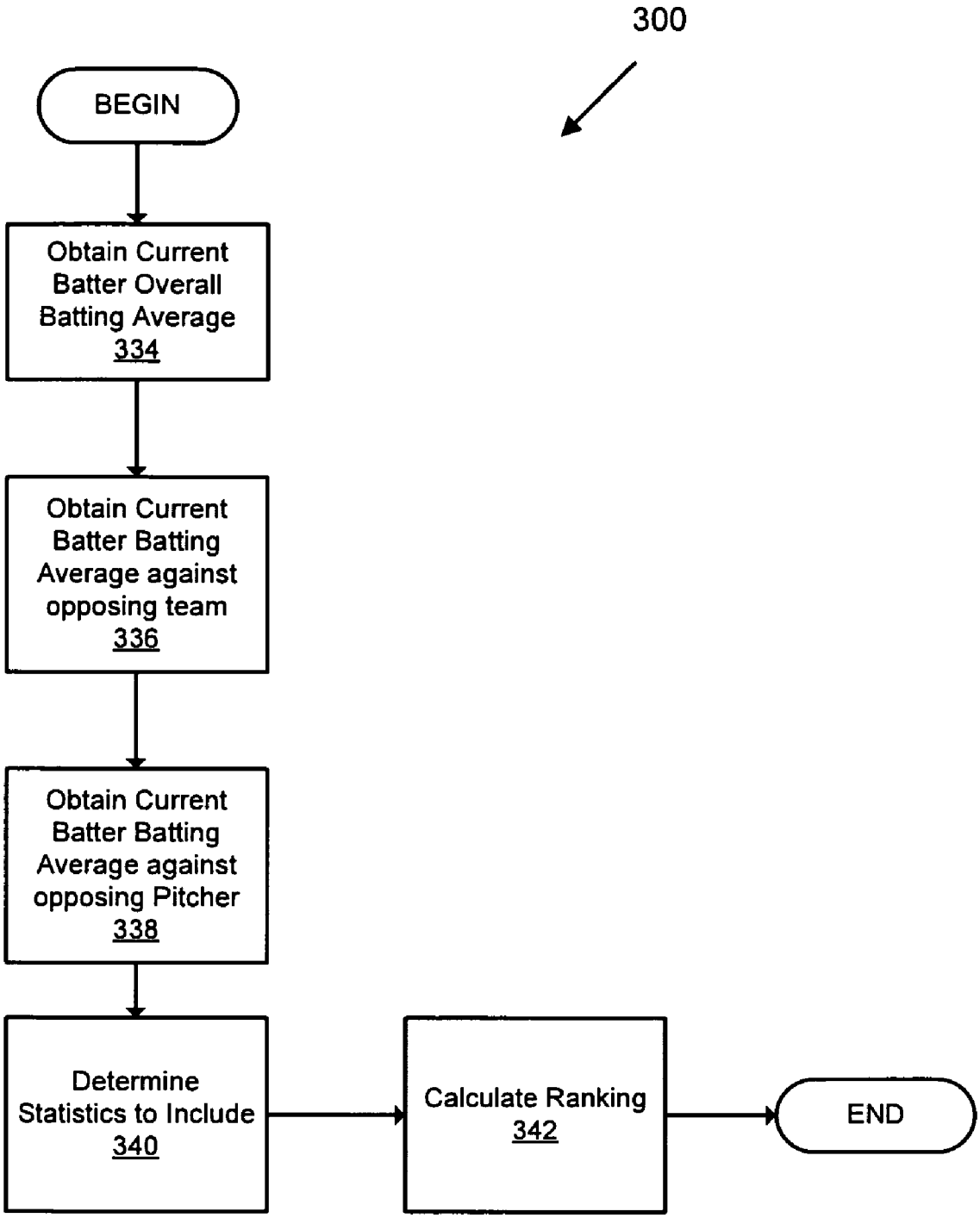
FIG. 3 is a flowchart showing process steps for ranking predictions in accordance with the present invention.

FIG. 3 is a flowchart 300 showing process steps for calculating the rank of predictions in accordance with an exemplary baseball embodiment of the present invention. This process is preferably performed by a computer system comprising a means to access player statistics, as well as a means to access live game data. In step 334, the overall average of the current batter is obtained (e.g. from a local or online database). In step 336, the average of the current batter against the opposing team is obtained. In step 338, the average of the current batter against the opposing pitcher is obtained. In step 340, the opposing team and opposing pitcher statistics are analyzed to determine if they should be included in the rank calculations. For example, if the current batter has never faced the opposing pitcher before, or faced that pitcher less than a predetermined number of times (e.g. less than 5 times), then the average of the current batter against the opposing pitcher is not included in the rank calculation.

The rank calculation is then performed in step 342, as:

$$T-(X*Bo+Y*Bt+Z*Bp)$$

Where X is a ranking factor for Bo, the overall batting average, Y is a ranking factor for Bt, the batting average against the opposing team, and Z is a ranking factor for Bp, the batting average against the opposing pitcher. T a staring value that is greater than the possible value of the sum of the ranking factor products. For example, suppose T is 10 and the current values of X, Y, and Z are 3, 5, and 7 respectively. Suppose that the current batter's averages are Bo=0.333, Bt=0.297, and Bp=0.109. The formula then provides the result of 6.753, which is optionally rounded to 7, to provide a rank of 7 for the outcome of a base hit under these circumstances. As can be observed from the formula, a player with a higher batting average will generate a base hit ranking lower than that of a player with a lower batting average, since there is a greater probability of the batter with the higher batting average to get a base hit, hence the ranking is lower. A similar approach is used for other ranking other predictions, such as a walk or a home run, for example.

Figure 4:
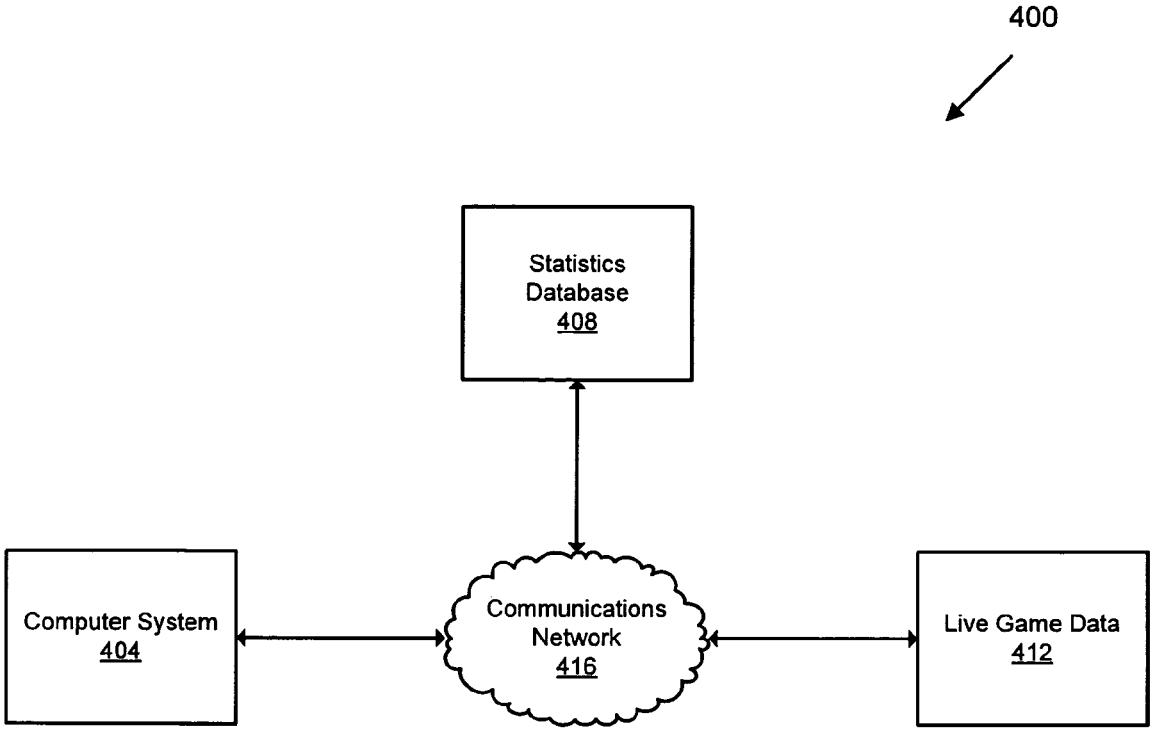
FIG. 4 shows a block diagram of an exemplary system for playing the game of the present invention.

FIG. 4 shows a block diagram of an exemplary system 400 for playing the game of the present invention. Computer system 404 may take the form of a desktop or laptop computer, or mobile device such as a telephone or portable digital assistant (PDA). Computer system 404 communicates with statistics database 408, and live game data feed 412, via communications network 416. Communications network 416 may be the Internet, or another network, such as a proprietary wireless network of a mobile phone provider. The live game feed data is provided by a content provider in a computer-readable format, such as XML data. Live game feed data is currently known in the art. Examples of such services include "Game Channel" by YAHOO (Sunnyvale, Calif.). The statistics database 408 comprises a database storing the pertinent statistics for each player. As is known in the art, computer system 404 provides a user display (not shown) and user input means (not shown) for presenting data to a user, and allowing a user to provide input to act on that data (e.g. making selections to form a subset list as in step 108. In this way, it is possible to play the game of the present invention almost anywhere, such as on a mobile phone at a live event or other public venue, as well as at home on a PC or gaming console.

Figure 5:
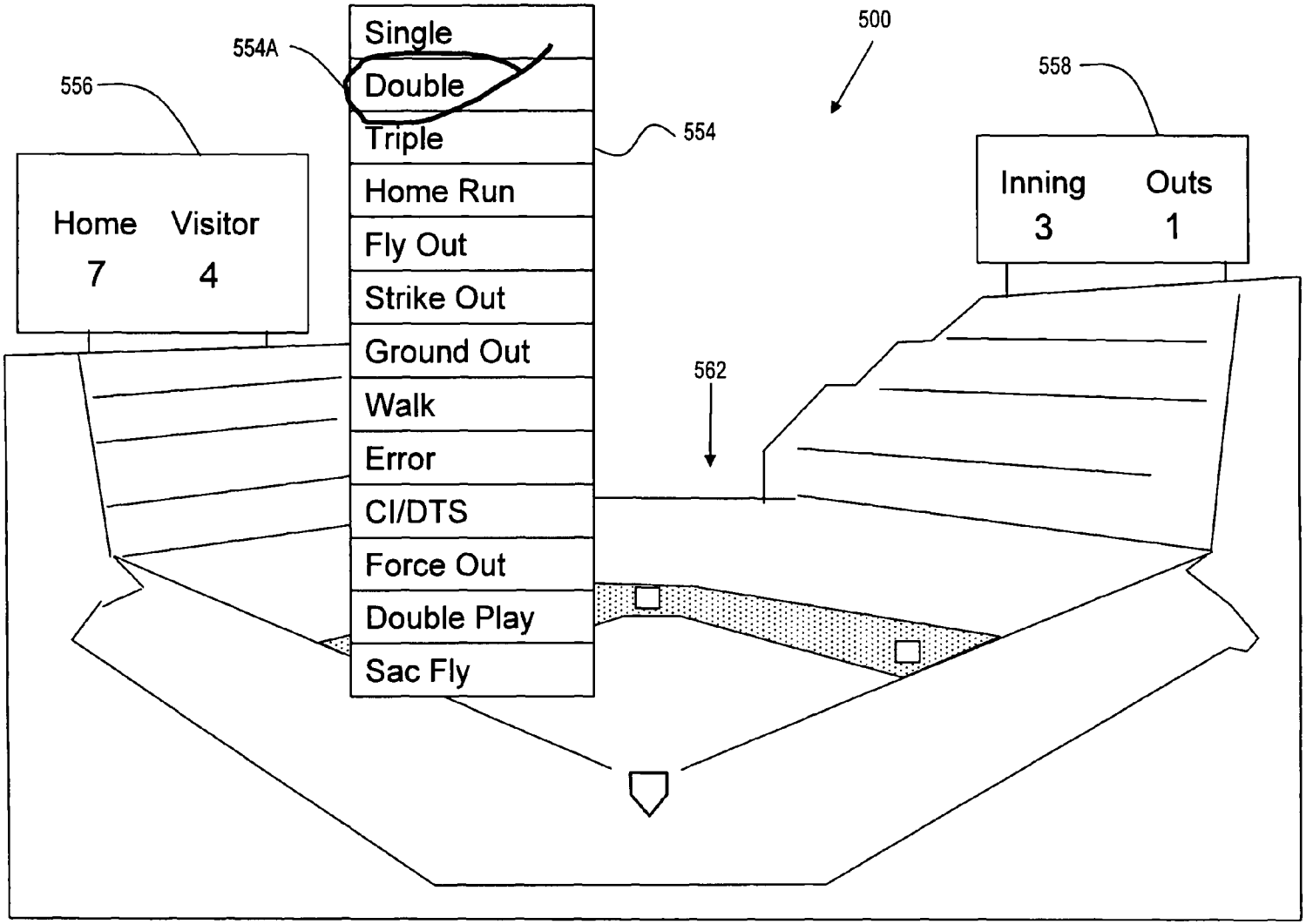
FIG. 5 shows an exemplary scorekeeping user interface of a baseball embodiment of the present invention.

FIG. 5 shows an exemplary scorekeeping user interface 500 of a baseball embodiment of the present invention. In one embodiment of the present invention, the user interface is implemented in the form of a writable medium such as a dry-erase board, cardboard, or paper tablet. No computer or subscription to a service provider is required. The user interface 500 has a pre-printed list of predictions (e.g.: possible outcomes) 554. In the simplest form, the player selects one outcome, in this case indicated as 554A ("double"). If the next play of the real game is a double, the player awards a point for the corresponding team in information area 556. If the next play of the real game is not a double, the player increments the outs and innings of the game of the present invention accordingly, in information area 558. This information is optionally superimposed on an image 562 of a sports venue. In one implementation, it is contemplated that the sports venue would be that of the team which is hosting the real game. For example, if the home team of the real game was the New York Mets, then the image 562 would be that of Shea Stadium. In this case, information areas 556 and 558 are optionally rendered to resemble stadium scoreboards. User interface 500 may also be implemented on a computer, such as a PC or laptop, or mobile device such as a mobile telephone, without departing from the scope of the present invention. Pre-printed list 554 is by no means exhaustive. Other possible outcomes listed may include, but are not limited to, stolen base, pickoff, dropped third strike, and hit by pitch, to name a few.

Figure 6:
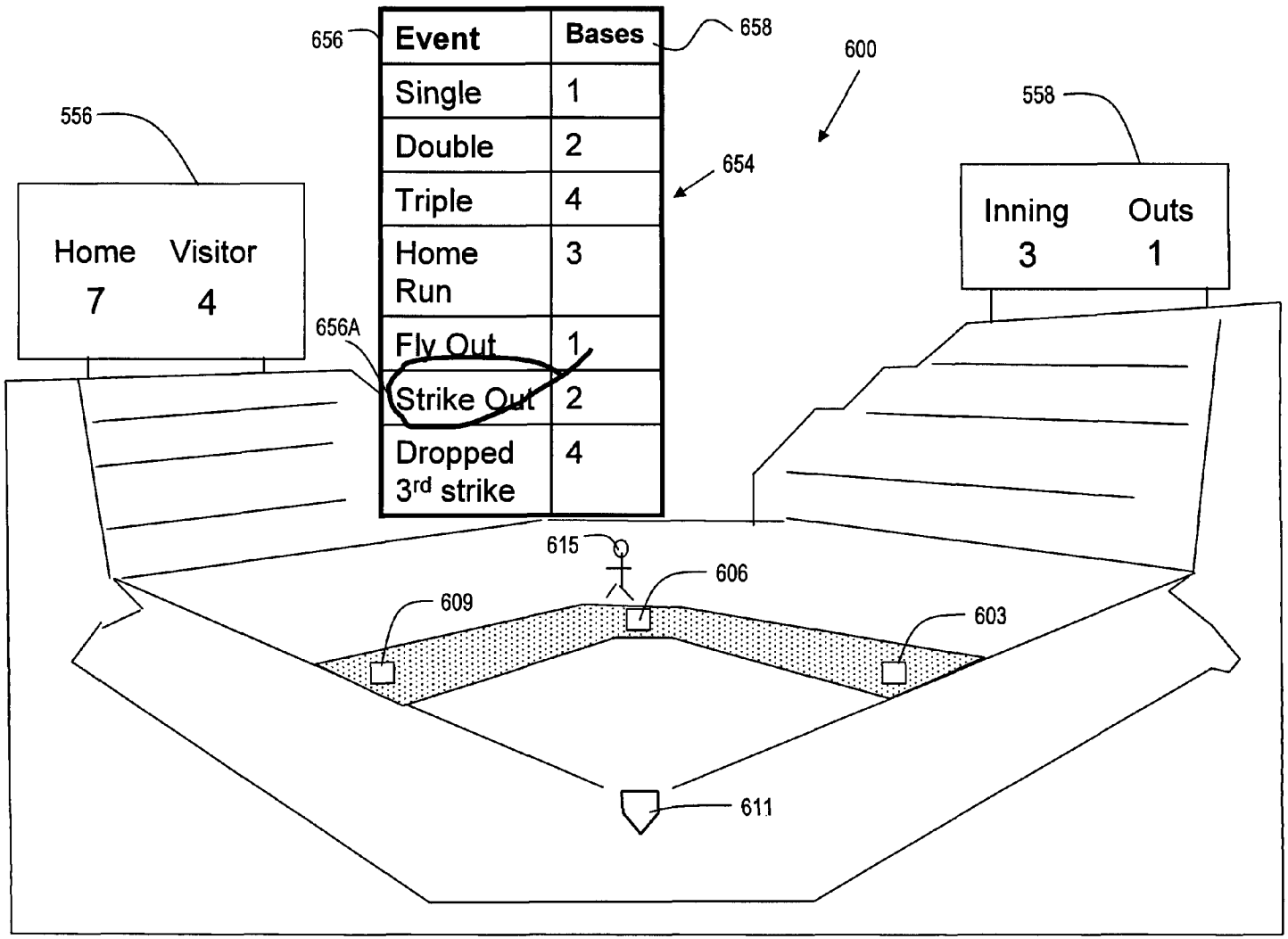
FIG. 6 shows an alternative embodiment of the present invention.

FIG. 6 shows an alternative embodiment of the present invention. In this case, instead of simply awarding points for correct predictions, the players are awarded "bases." The likelihood of a particular outcome determines how many bases are awarded. In this case scorekeeping user interface 600 has a pre-printed list of predictions 654. Prediction list 654 has an event column 656 that lists various outcomes of a play. Each outcome has a corresponding base value in the bases column 658. In the example shown in FIG. 6, a single is worth one base, and a double is worth two bases, etc. . . . . Note that a triple is actually worth more bases than a home run. This is because a triple is a less frequent occurrence than a home run. In an alternative embodiment, the base hits can map directly to a base value in column 658. I.e. a triple would be three bases, and a home run would be four bases.

In general, the less likely an event is, the more bases are awarded if that event is correctly predicted. First base 603, second base 606, third base 609, and home plate 611 are preferably rendered on a dry erase surface, or magnetic surface, so that base runner indicators may be conveniently added and removed as play of the game proceeds.

In the example of FIG. 6, the player has correctly predicted event 656A (a strikeout), and indicates a two base outcome by base runner indicator 615. In one embodiment, base runner indicator 615 may be hand drawn on a "dry erase" surface, such as a dry erase board. Alternatively, the base runner indicator 615 may be a magnet on a magnetic surface, or any other convenient fastening means. In an electronic version (e.g. on a personal computer) the base runner indicator 615 is integrated into the display. While many variations on the rules are possible, it is anticipated that a popular method of play is to advance each base runner indicator by the number of bases awarded for the current outcome. For example, given the scenario illustrated in FIG. 6, with a base runner indicator 615 on second base 606, if the next outcome were a single, the position of base runner indicator 615 is moved to third base 609. If the next outcome instead were a double or strike out (both events are worth two bases), then the base position would advance to home plate 611, and a run would be indicated in information area 556. In this embodiment, not only does the player predict a baseball outcome, but the scoring mechanism mimics that of the real game. In this embodiment, it is possible to "strand" base runners if three outs are made while base runners are on a base. In this way, the players become very engrossed in the baseball game on multiple levels, adding further fun and excitement to America's pastime.

Accordingly, the reader will see that the disclosed game and method of playing provide for an interactive experience that enhances the enjoyment of watching, or listening to, a live sporting event. Although the descriptions above contain specific details, these should not be construed as limiting the scope of the invention, but merely as providing illustrations of some of the presently preferred embodiments of this invention.

What is claimed is:

1. An interactive baseball-themed game that is played along with a live sporting event, the sports-themed game comprising:

a scorekeeping user interface comprised of a writable medium, the scorekeeping user interface comprising an information area for recording scores for a home player and a visitor player, and an information area for recording innings and outs;

a printed list displaying a plurality of possible outcomes and an associated point value for each of the possible outcomes, for a play of the live sporting event, wherein the printed list is disposed on the writable medium; wherein the plurality of possible outcomes is ranked according to probability of occurrence during a live baseball game such that higher point values are associated with outcomes having a lower probability of occurrence; whereby a player is awarded the associated point value upon correctly predicting one of the possible outcomes on the printed list, and records the awarded points on the scorekeeping user interface.

2. The game of claim 1, wherein the plurality of possible outcomes comprises single, double, triple, home run, fly out, ground out, and strike out.

3. The game of claim 2, wherein the list displaying the plurality of possible outcomes further comprises walk, dropped third strike, bit by pitch, pickoff, and stolen base.

4. The game of claim 1, wherein the scorekeeping user interface is superimposed on an image of a sports venue.

5. The game of claim 4, wherein the image of a sports venue comprises the infield of a baseball field, comprising presentation of first base, second base, and third base, and wherein the writeable medium comprises a magnetic surface, and further comprising a plurality of magnetic base runner indicators adapted to be affixed to the bases during game play.

6. The game of claim 4, wherein the scorekeeping user interface comprised of a writable medium is presented to resemble a scoreboard within the sports venue image.

7. The game of claim 1, wherein the writable medium is a dry erase board.

8. The game of claim 1, wherein the writable medium is comprised of cardboard.

* * * * *